US009051784B2

(12) United States Patent
Von Der Ohe et al.

(10) Patent No.: US 9,051,784 B2
(45) Date of Patent: Jun. 9, 2015

(54) RISER TENSIONER

(75) Inventors: Christian B. Von Der Ohe, Kristiansand (NO); David Bengt Johan Ankargren, Kristiansand (NO)

(73) Assignee: NATIONAL OILWELL VARCO NORWAY AS (NO)

( * ) Notice: Subject to any disclaimer, the term of this patent is extended or adjusted under 35 U.S.C. 154(b) by 529 days.

(21) Appl. No.: 13/496,195

(22) PCT Filed: Sep. 13, 2010

(86) PCT No.: PCT/NO2010/000335

§ 371 (c)(1), (2), (4) Date: May 14, 2012

(87) PCT Pub. No.: WO2011/034437

PCT Pub. Date: Mar. 24, 2011

(65) Prior Publication Data

US 2012/0217016 A1 Aug. 30, 2012

(30) Foreign Application Priority Data

Sep. 15, 2009 (NO) ..... 20093004

(51) Int. Cl.
*E21B 7/12* (2006.01)
*E21B 19/00* (2006.01)

(52) U.S. Cl.
CPC ..... *E21B 19/006* (2013.01)

(58) Field of Classification Search
CPC ..... E21B 19/004; E21B 19/006
USPC ..... 166/355, 367; 405/224.2, 224.4
See application file for complete search history.

(56) References Cited

U.S. PATENT DOCUMENTS

| | | | | | |
|---|---|---|---|---|---|
| 3,470,838 | A | * | 10/1969 | Daniell | 114/267 |
| 4,176,614 | A | * | 12/1979 | Goss et al. | 114/125 |
| 4,479,656 | A | * | 10/1984 | Collins | 277/322 |
| 4,951,743 | A | * | 8/1990 | Henderson | 166/84.1 |
| 5,160,219 | A | * | 11/1992 | Arlt | 405/195.1 |
| 5,252,005 | A | * | 10/1993 | Koos | 405/224.4 |
| 5,484,024 | A | * | 1/1996 | Ladd et al. | 166/369 |
| 5,628,586 | A | * | 5/1997 | Arlt, III | 405/195.1 |
| 5,846,028 | A | * | 12/1998 | Thory | 405/195.1 |
| 6,045,296 | A | * | 4/2000 | Otten et al. | 405/195.1 |
| 6,470,969 | B1 | * | 10/2002 | Sørhaug et al. | 166/355 |
| 6,835,026 | B2 | * | 12/2004 | Gjedebo | 405/224.4 |
| 2005/0147473 | A1 | | 7/2005 | Pallini et al. | |

FOREIGN PATENT DOCUMENTS

GB 2441212 A 2/2008

OTHER PUBLICATIONS

PCT/NO2010/000335 Written Opinion of the International Searching Authority dated Nov. 11, 2010 (4 p.).
PCT/NO2010/000335 Written Opinion of the International Preliminary Examining Authority dated Sep. 2, 2011 (5 p.).
PCT/NO2010/000335 International Search Report dated Nov. 12, 2010 (3 p.).

* cited by examiner

*Primary Examiner* — Matthew Buck
*Assistant Examiner* — Aaron Lembo
(74) *Attorney, Agent, or Firm* — Conley Rose, P.C.

(57) ABSTRACT

An apparatus for tensioning a marine riser comprising a support for a number of actuators, where the support is connected to a vessel's structure, and where each actuator is connected to the support and to a marine riser, and where elements of the riser tensioner apparatus are enclosed.

29 Claims, 3 Drawing Sheets

II–II

II-II

RISER TENSIONER

CROSS-REFERENCE TO RELATED APPLICATIONS

The present application is a United States of America national phase entry for PCT application N02010/000335, which has International filing date: Sep. 13, 2010. The present application claims priority the stated PCT application, which claims priority to Norwegian application No. 20093004, filed Sep. 15, 2009. Both applications are incorporated herein by reference.

STATEMENT REGARDING FEDERALLY SPONSORED RESEARCH OR DEVELOPMENT

Not applicable.

BACKGROUND

A riser tensioner is present on all vessels connected to a marine riser. The purpose of the tensioner is basically to carry the weight of the riser and apply additional top tensioning force to the riser as well as absorbing movement between the vessel and the marine riser.

Due to space and cost savings in combination with good technical function, hydraulic riser tensioners are widely used.

Hydraulic riser tensioners employ hydraulic cylinders as their active element. The end portion of the hydraulic cylinder that includes the fluid cylinder part of the hydraulic cylinder is often connected to a support frame, the support frame being fixed to the vessel. The hydraulic cylinders piston rod end portion is often connected to the riser.

The piston rod of the hydraulic cylinder is exposed to the environment when outside the cylinder. It is well known that the piston rod is attacked by chloride ions from the marine environment. In addition grit and other particles coming through the air attaches to the often wet piston rod. The result is corrosion and increased wear of the piston rod, bearings, and seals.

Extensive work has been undertaken in order to develop materials and designs that are able to withstand such harsh working conditions. Although progress has been made, the problem is not solved, and maintenance cost is running higher than acceptable. Therefore, apparatus to overcome or reduce at least one of the disadvantages of the prior art would be welcome by the industry.

BRIEF SUMMARY OF THE DISCLOSURE

There is provided a riser tensioner comprising a support for a number of actuators, where the support is connected to a vessel's structure, and where each actuator is connected to the support and to a marine riser, wherein the riser tensioner is enclosed.

The riser tensioner may be designed so that the support provides part of an enclosure, or have separate elements designed for the purpose of enclosing at least a part of the riser tensioner.

The riser tensioner may be gastight, thus making it possible to keep the outside atmosphere away from elements of the riser tensioner susceptible to failure arising from exposure to dirt and/or corrosion, as examples.

A first material may cover an area located between the riser, or an extension of the riser, above a carrier ring and the support, the carrier ring providing a connection between the riser and the actuators.

A second material may cover an area located between the riser below the carrier ring and the support. At least the first or the second material may be elastic.

The riser tensioner may be filled with gas having another composition than air, possibly an inert gas or a gas containing nitrogen.

The support may include a cylindrical or conical shell in its main structure. A shell, having its longitudinal axis substantially concentric to the marine riser in its center position, provides a strong and cost effective load carrying element.

The actuators may be connected to the shell via a reinforcement member. In certain embodiments, the reinforcement member is fixed to the support at the shell's upper portion.

In certain disclosed embodiments, the riser tensioner provides an excellent environment for sensitive internal components. Further, such design of the riser tensioner lends itself to a relatively simple, space saving and cost effective layout of the support and associated items.

BRIEF SUMMARY OF THE DRAWINGS

Below, an example of a riser tensioner is explained under reference to the enclosed drawings, where.

DETAILED DESCRIPTION OF THE DISCLOSED EMBODIMENTS

Figure 1:
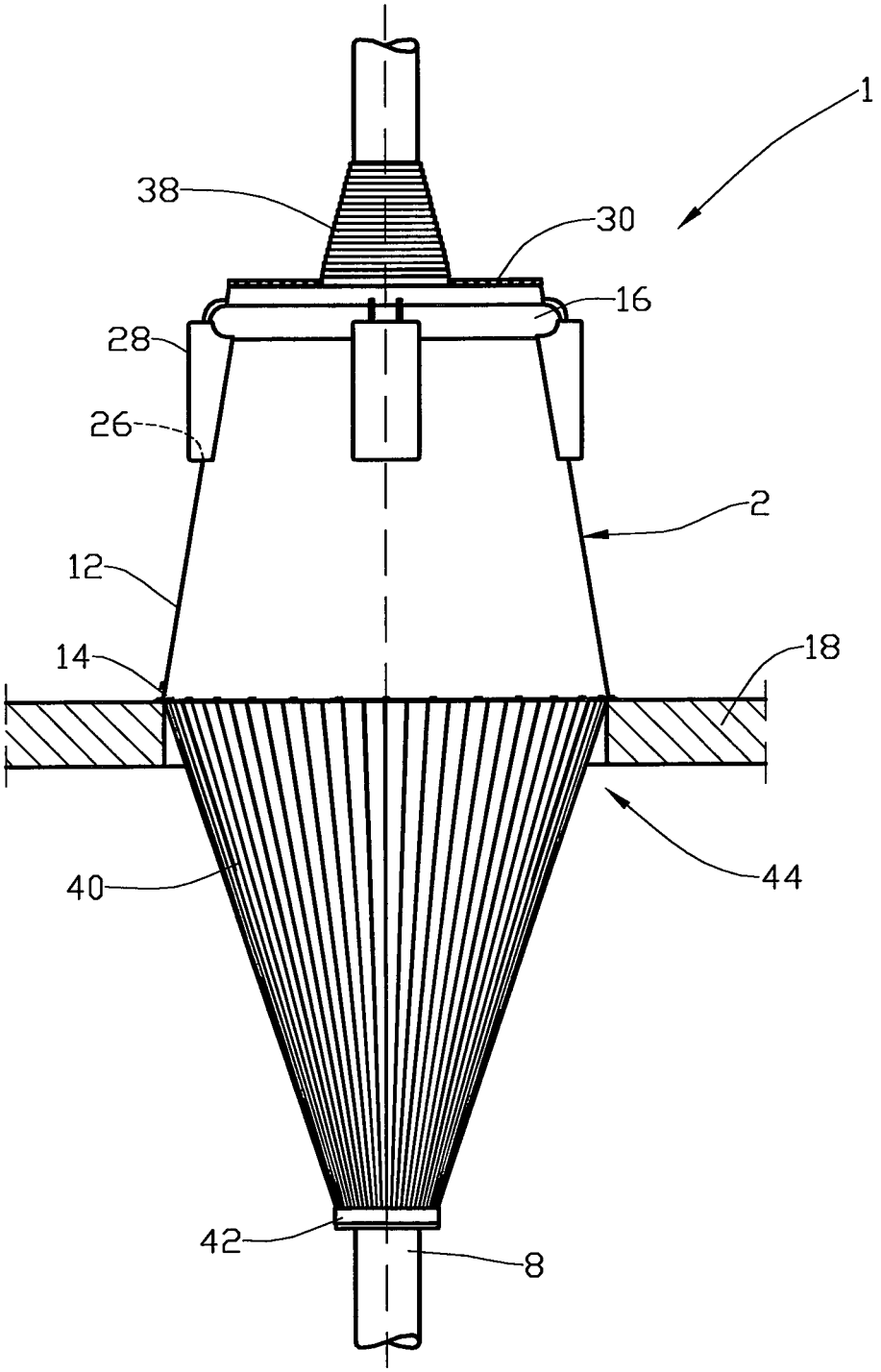
FIG. 1 shows a schematic side view of a riser tensioner in accordance with principles described herein.

On the drawings the reference number 1 denotes a riser tensioner including a support 2 for a number of actuators, here in the form of hydraulic cylinders, the actuators 4 being connected to the support 2 at their first end portion 6, and the second end portion 10 of the actuators 4 being connected to a marine riser 8 at a position below the connection point of their first end portion 6. Thus, the actuators develop tension in the riser by a contraction or a pulling action of the cylinders.

Figure 2:
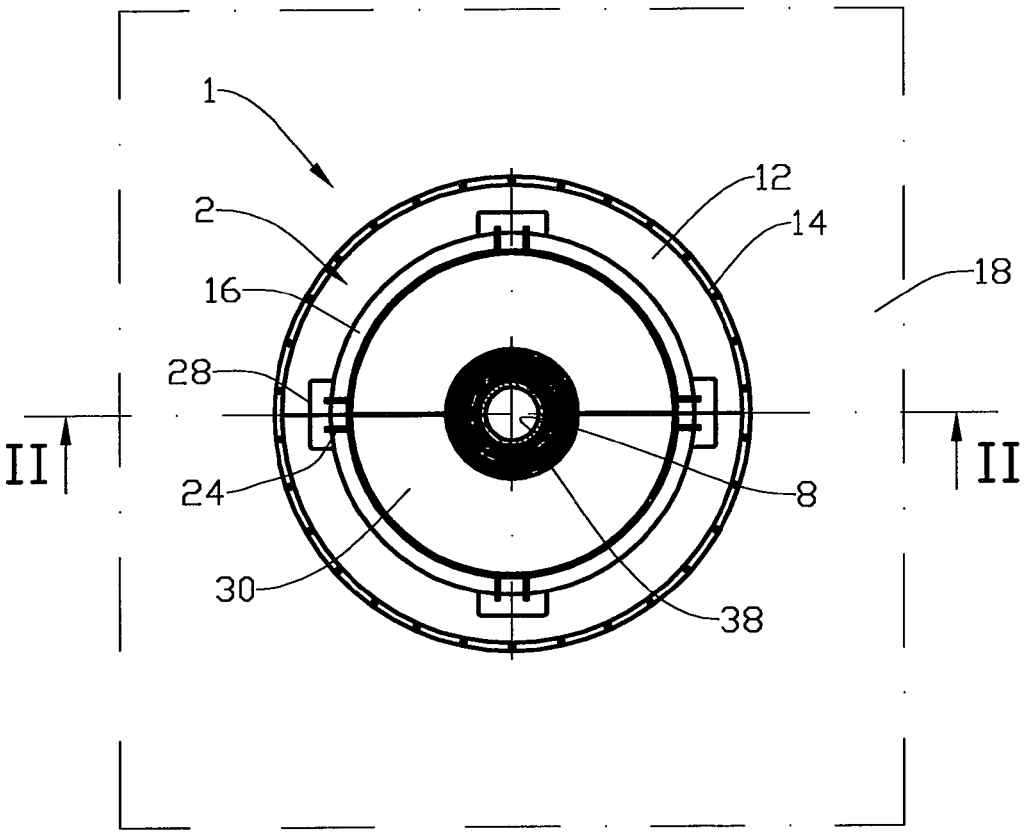
FIG. 2 shows a plan view of the riser tensioner in FIG. 1.
Figure 3:
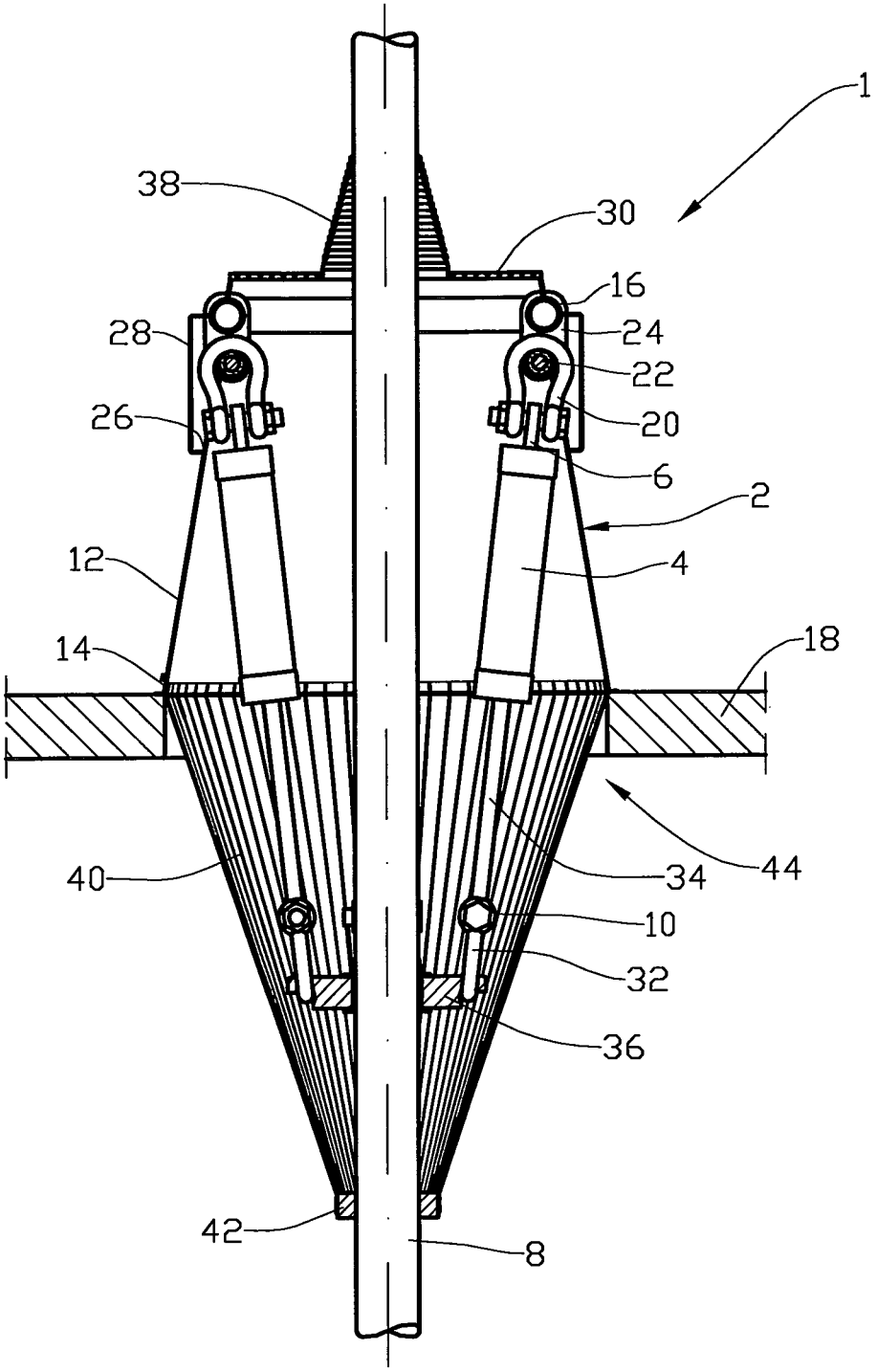
FIG. 3 shows a section view as taken at II-II in FIG. 2.

The support 2 may include a cylindrical or conical shell in its main structure. The shell, having its longitudinal axis substantially concentric to the marine riser, provides a strong and cost effective load carrying element. The support 2 in the embodiment of FIGS. 1 to 3 includes a load carrying structure 12 in the form of a conical shell 12, extending substantially concentric relative the riser 8 between a flange 14 and a reinforcement member 16.

The flange 14 is fixed to a vessel's structure 18. The reinforcement member 16, here in the form of a hollow torus, is fixed to the structure 12. In the embodiment shown, the reinforcement member 16 is fixed to the upper portion of the structure 12 of support 2.

Each actuator 4 is connected to the reinforcement member 16 via a first shackle 20 that is supported by a stub axle 22. The stub axle 22 that is positioned below the reinforcement member 16 is fixed to the reinforcement member 16 by two members 24.

At each actuator 4 there is provided an aperture 26 in the structure 12. The purpose of the aperture 26 is to make room for the first shackle 20 as well as ease maintenance work on the actuator 4. The aperture 26 is boxed in by a removable cover 28. The cover 28 may be load carrying.

The support 2 is provided with a preferably at least partly removable lid 30. The lid 30, when removed, provides access to the inside of the support 2.

At its second end portion 10 each actuator 4 is connected to the riser 8 via a second shackle 32. The second shackle 32 connects the actuators 4 piston rod 34 to a carrier ring 36 on the riser 8.

A flexible first material 38 encircles the riser 8 above the lid 30. The first material 38, that is clamped to the riser 8 and bolted to the support 2, or more accurately, to the lid 30, is extendable and substantially gastight.

Similarly, a flexible second material 40 encircles the riser 8 below the support 2. The second material 40 is clamped to the riser 8 at a clamp ring 42, and bolted to the support 2 at the flange 14.

The support 2 with the structure 12, covers 28, the lid 30, the first material 38 and the second material 40 together with their fasteners provide a substantially gastight enclosure 44 for the riser tensioner 1, thus making it possible to keep the outside atmosphere away from elements of the riser tensioner susceptible to failure arising from exposure to dirt and/or corrosion, as examples. To be gastight or substantially gastight, various components of enclosure 44 are sealed to one another. The riser tensioner 1 may be filled with a gas having composition other than air, possibly an inert gas or a gas containing nitrogen.

Conventional equipment related to the actuators 4 such as pipes, sensors and cables are not shown.

As the structure 18 moves relative to the riser 8, the movement between the riser 8 and the riser tensioner 1 is absorbed by the elasticity of the first and second material 38, 40 thus keeping the interior of the riser tensioner 1 closed from the outside atmosphere.

In another embodiment, the ring 42 is slidable and may have a seal on the inside. The ring 42 may slide along the riser 8 as the support 2 moves relatively to the riser 8.

What is claimed is:

1. A riser tensioner comprising:
a plurality of hydraulic actuators,
a support, and
a carrier ring coupled to a marine riser,
wherein the support is connected to a vessel's structure, and wherein each of the plurality of actuators is connected to the support and to the marine riser,
wherein elements of the riser tensioner are enclosed relative the surroundings by an outer shell surrounding the through-going marine riser,
wherein the shell is sealably connected to at least a flexible first material and a flexible second material,
wherein the flexible first and second materials are connected to the marine riser or an extension of the marine riser, and
wherein the flexible first material is disposed above the carrier ring and covers an area between the support and the marine riser or an extension of the marine riser.

2. A device according to claim 1, wherein the shell is substantially gastight.

3. A device according to claim 1 wherein the carrier ring is coupled between the marine riser and the actuators.

4. A device according to claim 1 further comprising a carrier ring, wherein the flexible second material covers an area between the marine riser below the carrier ring and the support.

5. A device according to claim 1, wherein the riser tensioner is filled with gas having a composition other than air.

6. A device according to claim 5, wherein the gas is inert.

7. A device according to claim 5, wherein the gas contains nitrogen.

8. A device according to claim 1, wherein the support includes the shell; and wherein the shell is a load carrying member.

9. A device according to claim 8, wherein the actuators are connected to the structure via a reinforcement member.

10. A tensioning apparatus for a marine riser extending to a surface vessel, the tensioning apparatus comprising:
a plurality of actuators each having a first and second end portion,
a support for the actuators, the support including a load carrying outer shell configured to be coupled to a surface vessel's structure and to surround a portion of the riser;
a flexible first material configured to be sealably coupled between a first portion of the outer shell and the marine riser or an extension of the marine riser;
a flexible second material configured to be sealably coupled between a second portion of the outer shell and the marine riser or an extension of the marine riser;
wherein the first end portion of each actuator is coupled to the outer shell of the support, and the second end portion of each actuator is configured to couple to the riser; and
wherein the actuators are enclosed relative to the surroundings by the outer shell and by the first and second materials when the first and second materials sealably couple between the outer shell and the marine riser or an extension of the marine riser.

11. The apparatus of claim 10 wherein the actuators are hydraulic cylinders, and wherein the hydraulic cylinders are configured to develop tension in the marine riser by contraction.

12. The apparatus of claim 10, wherein the outer shell is substantially gastight.

13. The apparatus of claim 12, wherein the outer shell of the riser tensioner is filled with gas having a composition other than air.

14. The apparatus of claim 10, wherein the support further includes a toroidal shaped reinforcement member coupled between the outer shell and first end portion of each actuator.

15. The apparatus of claim 10, wherein the load carrying outer shell is configured to extend circumferentially around the marine riser.

16. The apparatus of claim 15, wherein the load carrying outer shell is frustoconical.

17. The apparatus of claim 10, wherein the outer shell further comprises a removable portion configured to provide access to the actuators for maintenance.

18. An apparatus for tensioning a marine riser that extends to a surface vessel, comprising:
a support configured to couple to the vessel;
an enclosure configured to couple to the vessel and to receive the riser therethrough; and
a plurality of actuators housed in the enclosure and having a first end coupled to the support and a second end configured to couple to the riser;
wherein the enclosure is configured to seal the actuators from the surroundings to protect the actuators from corrosion.

19. The apparatus of claim 18 wherein the enclosure comprises a flexible first material and a flexible second material;
wherein the support is sealably connected to the flexible first material and to the flexible second material; and
wherein the flexible first and second materials are configured to couple to the marine riser or to an extension of the marine riser.

20. The apparatus of claim 18, wherein the support comprises a load carrying outer shell that forms a sealing portion of the enclosure.

21. The apparatus of claim 20, wherein the load carrying outer shell is configured to extend circumferentially around the marine riser.

22. The apparatus of claim 18 further comprising a carrier ring;

wherein the second ends of the actuators are configured to couple to the riser by means of the carrier ring.

23. The apparatus of claim 22 further comprising a toroidal shaped reinforcement member;

wherein the first ends of the actuators couple to the support by means of the toroidal shaped reinforcement member.

24. The apparatus of claim 18 wherein the enclosure is configured to be filled with a gas having a composition other than air.

25. An apparatus for tensioning a marine riser that extends to a surface vessel, the apparatus comprising:

a support configured to couple to the vessel;

an enclosure configured to couple to the vessel and to receive the riser therethrough; and a plurality of actuators housed in the enclosure and having a first end coupled to the support and a second end configured to couple to the riser;

wherein the enclosure comprises at least one portion that is removable while the support is attached to the vessel and while the actuator is coupled to the riser.

26. The apparatus of claim 25, wherein the actuators are substantially sealed from the surroundings by the enclosure.

27. The apparatus of claim 26, wherein the enclosure is filled with gas having a composition other than air.

28. The apparatus of claim 21 wherein the support further comprises a toroidal reinforcement member coupled to the load carrying outer shell.

29. The apparatus of claim 21 wherein the load carrying outer shell is frustoconical.

* * * * *